United States Patent [19]

Kinley

[11] Patent Number: 4,572,288

[45] Date of Patent: Feb. 25, 1986

[54] TIME-DELAYED IGNITION SYSTEM FOR A DOWN-HOLE EXPLOSIVE TOOL

[75] Inventor: Karl S. Kinley, Houston, Tex.

[73] Assignee: J. C. Kinley Co., Houston, Tex.

[21] Appl. No.: 621,079

[22] Filed: Jun. 15, 1984

[51] Int. Cl.[4] ..... E21B 29/02; E21B 43/1185

[52] U.S. Cl. ..... 166/63; 175/4.54; 102/206; 102/215

[58] Field of Search ..... 166/63, 64, 65 R, 66, 166/297–299, 55.3, 250; 175/4.54, 4.56; 102/206, 215

[56] References Cited

U.S. PATENT DOCUMENTS 2,696,259 12/1954 Greene ..... 166/63

3,930,449 1/1976 Buchele ..... 102/206 X 4,217,826 8/1980 Young, Jr. et al. ..... 102/215 X 4,445,435 5/1984 Oswald ..... 102/215

*Primary Examiner*—Stephen J. Novosad

*Assistant Examiner*—Thuy M. Bui

*Attorney, Agent, or Firm*—Pravel, Gambrell, Hewitt & Kimball

[57] ABSTRACT

A time-delayed ignition system for a down-hole explosive tool such as a wireline cutter. The ignition system preferably includes: (a) a longitudinal housing; (b) means for supplying electrical current to the housing; (c) an electrical igniter located in the housing and operable to activate the down-hole tool by applying the electrical current to the igniter, and (d) means for delaying application of the current to the igniter until a predetermined period of time has elapsed. Preferably, the time-delay means are electronic and disposed within the housing.

12 Claims, 4 Drawing Figures

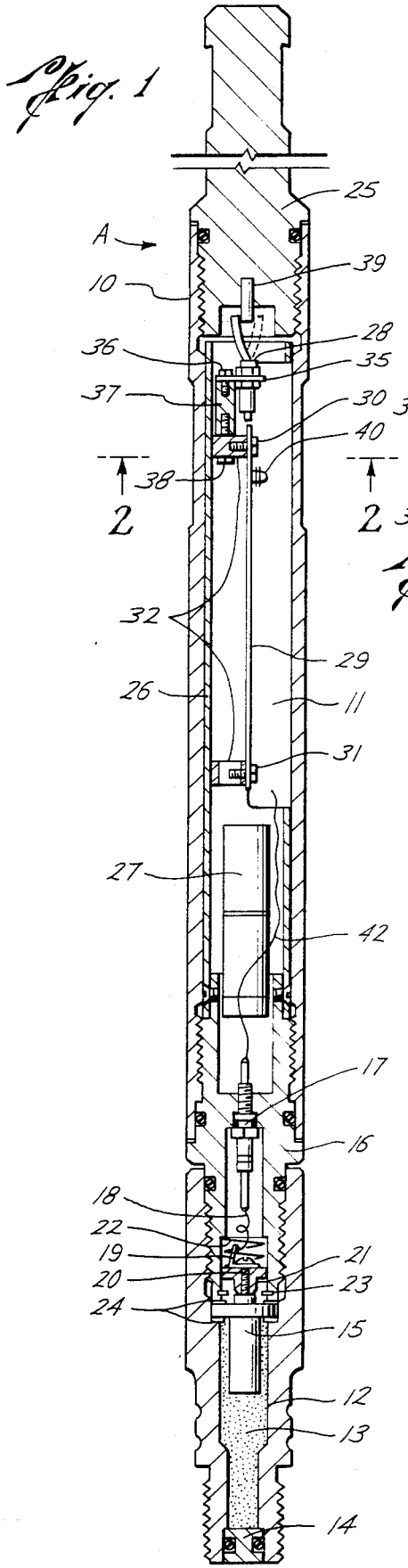
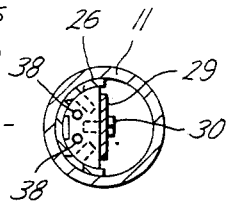
Fig. 2
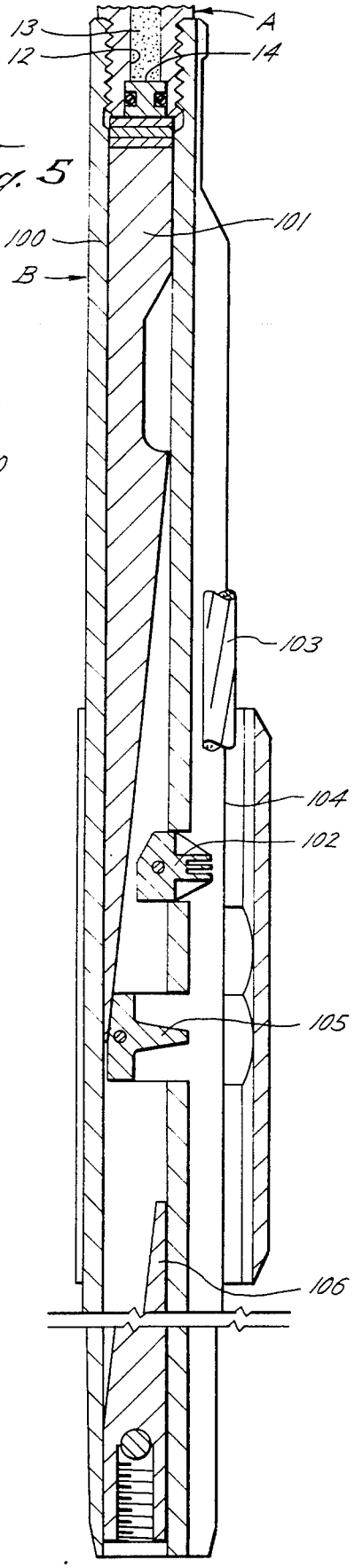

29
FREQUENCY ADJUSTMENT CIRCUIT
52
R1
C1
FROM BATTERY
E1 +
E2 −
GROUND
50
M2 M3 M1
M5
M8
M14
M9
M11
M4
M6
M7
M12
MULTI-VIBRATOR
51
BC10
BC16
BC8
BINARY COUNTER
BC3
BC9
BC11
53
D1
R2
C2
C3
COUNTER RESET CIRCUIT
54
ON/OFF L.E.D.
R3
R4
40
Q1
R5
E3 TO IGNITER
Q2
S
D
G
C4
R6
55
R7
Q3
R8
R9
SWITCHING CIRCUIT

TIME-DELAYED IGNITION SYSTEM FOR A DOWN-HOLE EXPLOSIVE TOOL

FIELD OF THE INVENTION

This invention pertains to a time-delayed ignition system for a down-hole explosive tool. Specifically, this invention pertains to an ignition system having an electronic timer and electrical igniter to activate a down-hole explosive tool such as a wireline shooting tool.

BACKGROUND OF THE INVENTION

In the drilling and completion of an oilwell, it is often desirable to use a down-hole explosive tool. Examples of such down-hole explosive tools include a wireline shooting tool, such as that disclosed in U.S. Pat. No. 3,199,596, and perforators for inserting an orifice insert or flow control device in a well pipe, such as that disclosed in U.S. Pat. No. 3,366,179. Typically, these tools are put in place in the wellbore and an explosive charge in the tool is set off by dropping a weight down the wellbore which strikes a firing head on the upper portion of the down-hole tool. The firing head causes a firing pin to detonate a shell, resulting in the detonation or explosion of the explosive in the tool.

The use of these tools involves considerable uncertainty on the part of the tool operator. In the case of the wireline cutter, it was used to cut the wireline which supported an operating tool which has become stuck or could not be retrieved by the wireline itself. Frequently, when the wireline cutter was dropped by sliding down the wireline, sand or other solids in the oilwell have fallen and packed around the wireline above the cutter. When the weight was thereafter dropped for impact with the cutter to detonate the explosive and thus to cut the wireline, the sand or other solids sometimes prevented the weight from impacting the cutter and thus prevented the detonation of the explosive and the functioning of the cutter, so that the wireline was not cut and could not be retrieved.

One method which was used to prevent the cutter from becoming buried and failing to be set off when the weight was dropped was to drop the weight before the cutter reached the bottom of the hole. However, the sand or other solid material may still have interfered with the weight contacting the cutter or it may have retarded the descent of the tool. Since the weight was smaller than the tool and, thus, its descent was not as retarded by the sand and scale, it dropped faster than the tool. Thus, if the weight was dropped too closely behind the cutter or other down-hole tool, the weight caught up to the tool before it reached the operating tool in the wireline and set it off prematurely so that the wireline was cut at a higher point in the well than desired. When an excess of the wireline above the operating tool was left in the well, difficulties were encountered in the subsequent fishing job in the well to retrieve the stuck operating tool.

One attempt to solve the above problems was the use of a chemical actuated timer device disclosed in U.S. Pat. No. 3,010,515. As disclosed in that patent, a spring-loaded plunger was used to strike the firing pin. The plunger was prevented from striking the firing pin by a locking pin. Before the tool was dropped, a chemical was released which reacted with the material of the locking pin. When the locking pin become incompetent by the action of the chemical, the plunger struck the firing pin and the explosive tool was activated. Not only was the use of the chemical timer of the patent hazardous to the operator, but reuse required cleaning of the tool, replacement of the locking pin, and placing of a new chemical container in the timer with the potentially dangerous chemical. Further, the reliablity and accuracy of the timing period was dependent on variables, such as, for example, the strength of the chemical, down-hole temperature, and the type and size of the locking pin, which has made the use of the chemical timer of limited practical value. In use, the locking pin might not be completely reacted with the chemical so that the movement of the plunger was retarded, resulting in the firing pin not being struck with enough force to detonate the explosive in the tool.

In contrast, the ignition system of the present invention provides a precise timing mechanism for activating a down-hole tool such as a wireline cutter so that premature firing is prevented, and failure to fire by reason of solids accumulating at the area above the tool is avoided. Further, the ignition system of the present invention may be conveniently and safely prepared for reuse.

SUMMARY OF THE INVENTION

The present invention is a a new and improved down-hole explosive well tool which has an electrical igniter which is operable to activate the down-hole tool to perform a wireline cutting operation or other function down-hole by applying electric current to the igniter after a predetermined period of time has elapsed. The invention is more readily understood by the accompanying drawings and the following detailed description of the preferred embodiments.

BRIEF DESCRIPTION OF THE DRAWINGS

FIG. 1 shows a vertical sectional view, partly in elevation, of an embodiment of the invention.

FIG. 2 is a cross-sectional view of the device shown in FIG. 1 taken along the lines 2—2, and further illustrates the construction of the apparatus of this invention.

FIG. 5 is a vertical sectional view of a typical wireline cutter which is adapted to be connected below the apparatus of this invention for actuation to cut a wireline down-hole in a well.

DETAILED DESCRIPTION OF THE PREFERRED EMBODIMENTS

Figure 3:
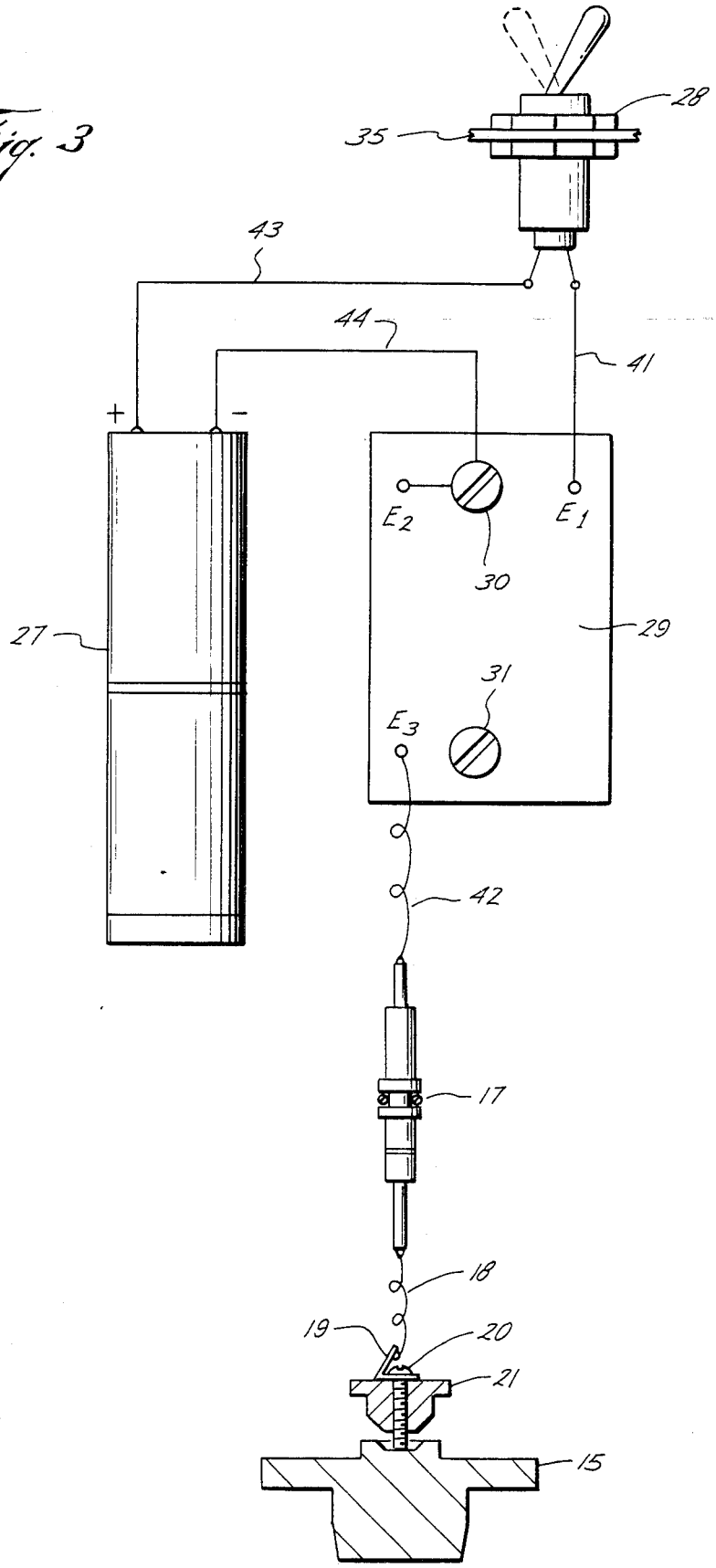
FIG. 3 is a schematic wiring diagram of an embodiment of the significant electrical components of the ignition system of this invention.

The tool A is illustrated in the drawings in a simplified form which includes a tubular barrel or housing 10, normally made up of several connected parts for ease of manufacture and assembly. Barrel 10 is provided with lower chamber 12 in which explosive charge 13 is disposed, with retaining seal 14 at its lower end. Igniter 15 is disposed above explosive charge 13. Igniter 15 should be of the electrically activated type, preferably of the standard size for use in down-hole tools, such as, for example, igniter BP-3 available from Baker Oil Tools, Inc. or igniter 204571 available from Whittaker Co.

Igniter 15 is held in place by housing member 16 which is screwed into lower chamber 12. Positive electrical current is conducted to igniter 15 through feed-through connector 17, wire 18, solder lug 19 and electrically conducting contact screw 20. Contact between contact screw 20 and igniter 15 is maintained by contact plunger 21 which is made of an electrically non-conductive material and biased by spring 22. Screw 20 and contact plunger 21 are held in place by retaining ring 23 when igniter 15 is not in place, such as, for example, when the ignition system is being prepared for reuse. Igniter 15 is grounded through contact with lower chamber 12 and housing member 16, by means of igniter gaskets 24 which are made of an electrically conductive material.

Upper chamber 11 in which the electronics are disposed is sealed from the formation fluid by a closure such as typical fishing neck 25. Disposed within upper chamber 11 is electronics support member 26 which has mounted thereon battery pack assembly 27, switch 28 and circuit board assembly 29. The positive terminal of battery pack assembly 27 is connected to switch 28 by wire 43 (see FIG. 3). The negative terminal of battery pack assembly 27 is connected by wire 44 (see FIG. 3) to circuit board assembly 29 at screw 30 which functions as a ground for circuit board assembly 29 and housing 10. Circuit board assembly 29 is held in position out of electrical contact with the conductive material of housing 10 and electronics support member 26 by means of screw 30, screw 31 and circuit board supports 32. Electronics support member 26 is preferably cylindrical at its lower portion and only partically cylindrical thereabove.

Switch 28 is held in place by switch plate 35, screws 36, switch plate support 37 (FIG. 1), supports 32 and screws 38. Switch 28 is disposed along the longitudinal axis of housing 10 in proximity of fishing neck 25. As seen in FIG. 1, fishing neck 25 is provided with roll pin 39. When fishing neck 25 is in place, roll pin 39 prevents switch 28 from being accidentally moved from the "on" position to the "off" position while the tool is descending in the hole, or from the "off" position to the "on" position during transportation or above ground handling, which might otherwise be caused by jarring or vibrations imparted to the tool.

Circuit board assembly 29 is provided with an electronic timer (see FIG. 4) and LED (light-emitting diode 40. The electronic timer provides a means of delaying application of the current to the igniter until a predetermined period of time has elapsed after switch 28 has been moved from the "off" position to the "on" position. When switch 28 is in the "on" position, electrical current is supplied to circuit board assembly 29 through wire 41 (see FIG. 3). The arrangement and design of circuit board assembly 29 is such that LED 40 emits light when electrical current is supplied to circuit board assembly 29. The light is visible to an operator when fishing neck 25 is not in place. The preferred time of delay is one hour, after which time period has elapsed, positive electrical current is supplied to igniter 15 by means of wire 42 (see FIG. 3) which is connected to feed-through connector 17.

A schematic wiring diagram showing the major electrical components of the ignition system is seen in FIG. 3. Switch 28 is connected in series to the positive terminal of battery pack assembly 27 by wire 43 and to connection $E_1$, on circuit board assembly 41. The negative terminal of battery pack assembly 27 is connected to screw 30 which grounds electronics support member 26, barrel 10 and the electronic components of circuit board assembly 29 at connection $E_2$. Upon elapse of the predetermined time period following the positioning of switch 28 in the "on" position, electrical current is supplied to igniter 15 through wire 42 connected to circuit board assembly 29 at connection $E_3$, feed-through connector 17, wire 18, solder lug 19 and screw 20 held in place by spring-biased contact plunger 21. The grounding of igniter 15 through gaskets 24, barrel 10, screw 30 and wire 44 completes the circuit, thereby effecting detonation of igniter 15.

Figure 4:
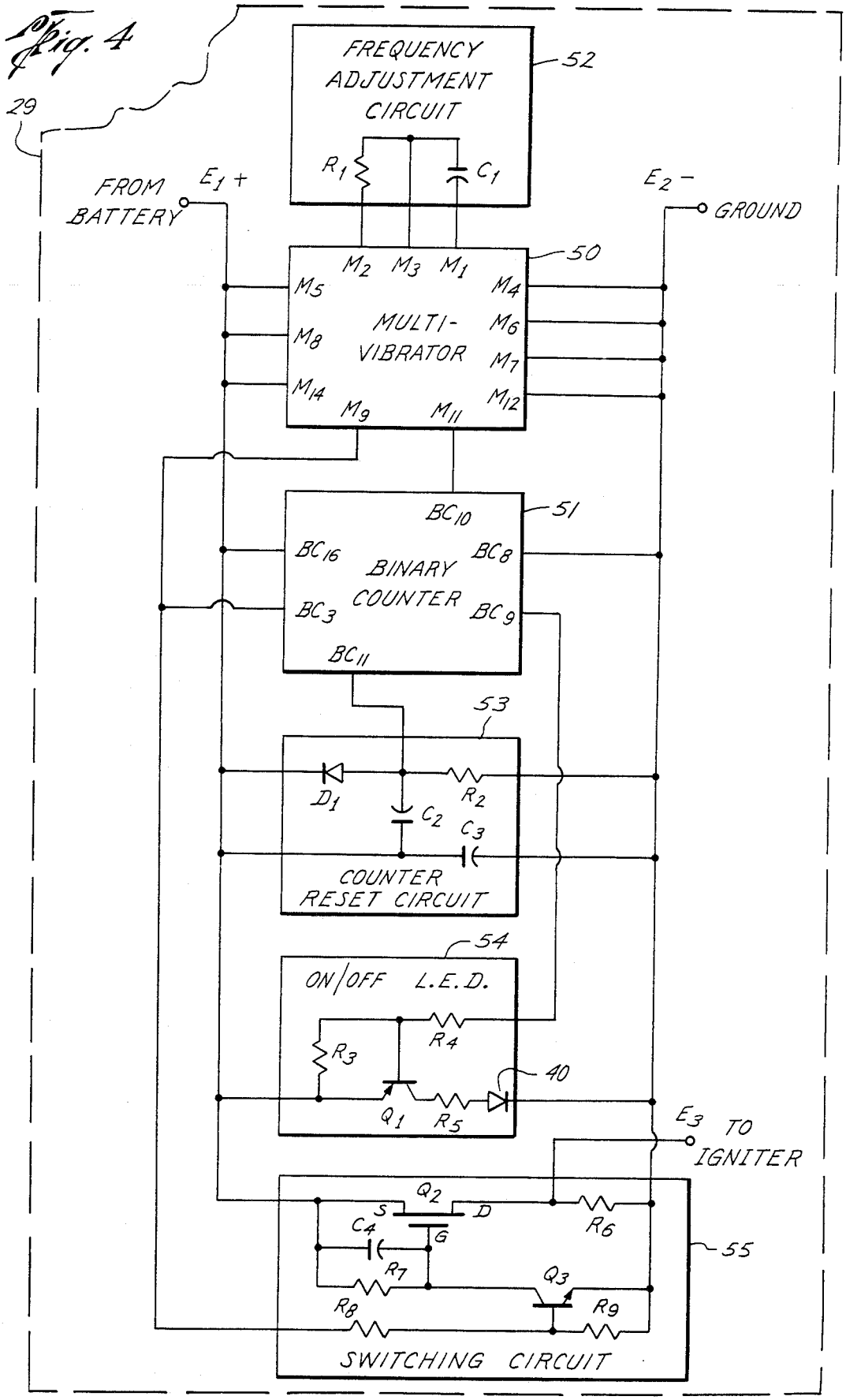
FIG. 4 is a schematic wiring diagram of an electronic timing device suitable for use in the ignition system of this invention.

Typical electronics of circuit board assembly 29 are schematically shown in FIG. 4. Typical components include multivibrator 50, binary counter 51, frequency adjustment circuit 52, counter reset circuit 53, on/off LED circuit 54, and electrical switching circuit 55. Multivibrator 50 is an astable multivibrator producing a clock signal. Multivibrator 50 is preferably that available from National Semicondutor Co., Part No. CD4047BJM. Binary counter 51 is preferably a fourteen-stage binary counter, preferably that available from National Semiconductor Co., Part No. CD4020BMJ. As used herein, subscripts on "BC" and "M" refer to manufacturer's pin numbers on the binary counter and multivibrator, respectively. Resistors $R_1$–$R_5$, $R_7$–$R_9$ are standard resistors commercially available from many sources, but are preferably thermally resistant, such at type RN55C available from Corning Co. Resistor $R_6$ is preferably a constant load resistor, and also preferably thermally resistant, such as type RN60C available from Corning Co. Capacitors $C_1$–$C_4$ can be of ceramic type. Preferably, capacitors $C_1$, $C_4$ have a dielectric of X7R or better and are high voltage capacitors to reduce the effect of battery voltage on the clock frequency. LED 40 is a light emitting diode positioned on circuit board assembly 29 so that it is visible to an operator when fishing neck 25 is removed. Diode $D_1$ is a small signal diode. Transistors $Q_1$, $Q_3$ are PNP BJT and NPN BJT transistors, respectively, such as National Semiconductor Part Nos. 2N2907 and 2N2222. Transistor $Q_2$ is a P-channel MOSFET, such as I.R. Co. Part No. IRF9530.

Circuit board assembly 29 performs a timing function. A fixed time delay, preferably one hour, is generated after power is applied to the circuit. Multivibrator 50 produces a clock signal of a frequency determined by frequency adjustment circuit 52. With a fourteen-stage binary counter and a desired time delay of one hour, the frequency of the clock singal is 2.28 Hz. After assembly of the circuit board, the frequency can be accurately adjusted by varying the resistance of resistor $R_1$. Preferably, the combination of resistance $R_1$ and capacitor $C_1$ should allow a frequency shift of less than one percent over battery voltages ranging from 5 to 15 volts. The clock frequency will be produced whenever the power is applied and the voltage at $M_9$ is low.

Binary counter 51 counts the clock pulses whenever power is applied, the clock input, $BC_{10}$, is receiving pulses, and the reset input, $BC_{11}$, has a low voltage. When power is first applied to the circuit board, counter reset circuit 53 generates a positive pulse on $BC_{11}$, thereby resetting binary counter 51. Within 0.3 seconds, $BC_{11}$ is returned to zero volts and the counter begins counting from zero. Resetting the counter also lowers the voltage at $M_9$, which is connected to $BC_3$ which is the $2^{14}$ output pin on binary counter 51, allowing the clock to operate.

After every clock cycle, the signal at $BC_9$ changes state. The $BC_9$ signal is used to control transistor $Q_1$ in on/off LED circuit 54. When the voltage at $BC_9$ is low, transistor $Q_1$ is on, and LED 40 is illuminated; when the voltage is high, transistor $Q_1$ is off, and the LED is not illuminated. The flashing of LED 40 indicates that the clock counter is advancing. When the count reaches 8192 ($2^{13}$), the signal at $BC_3$ will change from low to high voltage, turning off multivibrator 50, and freezing the count at 8192. The signal at $BC_3$ also activates transistor $Q_3$ which activates transistor $Q_2$, resulting in the application of current to connection $E_3$ which transmits the current to igniter 15 as described above. After the igniter fires, the battery is discharged through $R_6$ at a constant load and through LED 40.

In order for the circuit to perform properly, the battery voltage must be above ten volts to properly bias $Q_2$. Preferably, the battery voltage should not exceed seventeen volts.

A typical down-hole explosive tool with which the ignition system of the invention may be used is wireline cutter tool B shown in FIG. 5. Tool B is illustrated in a simplified form including housing 100, the upper end of which has screwed therein the lower end of lower chamber 12 of ignition system A. The detonation of explosive charge 13 is transmitted to drive wedge 101 which is provided with an inclined surface. The downward movement of drive wedge 101 resulting from the transmission of the detonation of the explosive charge thereto forces clamp 102 outwardly to secure a grip on wireline 103 in guide sleeve 104. The continued downward motion of drive wedge 101 forces knife 105 outwardly to cut wireline 103. The downward motion of drive wedge 101 is terminated when drive wedge 101 contacts stop wedge 106. Having thus effected the cutting of wireline 103, The clamp 102 is held securely in place by the inclined surface of drive wedge 101 so that the tools A and B can be lifted together with the wireline 103 to the surface.

In the operation of the ignition system of this invention, ignition system A is attached to a down-hole tool such as the cutter B (FIG. 5) and is readied to be lowered down the hole. Fishing neck 25 is removed, switch 28 is moved from the "off" position to the "on" position, the supply of current verified by observing intermittent light emission from LED 40, and fishing neck 25 is then replaced. The tool B is positioned on the wireline at the surface by passing the wireline 103 through the guide sleeve 104 on the housing 100. The tool B and the ignition system A therewith are then dropped down the well by sliding down the wireline 103. Roll pin 39 prevents the switch from accidentally moving to the "off" position during such descent, even if the ignition system is subject to excessive vibrations or jarring during its descent.

When the ignition system and tool have completed their descent to a point usually where the lower end of the tool B rests on the operating tool (not shown) therebelow which is connected to the lower end of the wireline 103, the tool B and ignition system A will rest at that position in the wall until the timer ignites the explosive charge. Since the detonation of the explosive charge is not activated by the dropping of a weight, the reliability of activating the detonation will not be subject to dislodged sand, scale or any other solids in the well which may accumulate on top of the tool and ignition system during or after such descent. When the predetermined period of time has elapsed, the electronic timer will cause electrical current from the battery pack assembly to be applied to igniter 15 through wire 42, feed through connector 17, wire 18, solder lug 19 and screw 20. The passage of electrical current through igniter 15 causes a heat buildup in igniter 15 which results in its detonation. The detonation of igniter 15 causes the detonation of explosive charge 13 which is transmitted to down-hole tool B to cause the drive wedge 101 to move downwardly in the housing 100 with considerable force. Drive wedge 101 forces clamp 102 and knife 105 outwardly from cutter housing 100, clamping and cutting wireline 103.

Thus, after the operator has waited the predetermined period of time, the tool and ignition assembly are normally retrieved from the well by lifting wireline 103. Depending on the application and tool used, it may in some instances be necessary or desirable to retrieve the tool and ignition system with a conventional fishing tool by engaging fishing neck 25 in the known manner.

The foregoing disclosure and description of the ignition system of this invention is illustrative and explanatory thereof and various changes in the size, shape and materials, as well as in the details of the illustrated construction may be made within the scope of the appended claims without departing from the spirit of the invention.

What is claimed is:

1. An apparatus for providing a time-delayed activation of a down-hole explosive tool, comprising:

a longitudinal housing adapted to be dropped in a well without being suspended from an electrical conductive line;

an explosive adapted to actuate the explosive tool;

means disposed within said housing for supplying electrical current to said housing;

an electrical igniter disposed within said housing;

means for positioning said igniter in proximity to said explosive for detonating said explosive;

said igniter being operable to activate the down-hole explosive tool by applying said current to said igniter; and means disposed within said housing for delaying application of said current to said igniter for a predetermined period of time, said delaying means including: a manually operable switch having an "off" position for preventing said application of said current and an "on" position for beginning said period of delay, and means for locking said switch in either of said positions.

2. The apparatus of claim 1, wherein said means for supplying electrical current are one or more batteries.

3. The apparatus of claim 1, wherein said explosive is disposed within said housing.

4. The apparatus of claim 1, wherein said predetermined period of time is about one hour.

5. The apparatus of claim 1, wherein said delaying means further include:

a circuit board; and means for mounting said circuit board in said housing.

6. An apparatus for providing a time delayed activation of a down-hole explosive tool, comprising:

a longitudinal housing adapted to be lowered in a well without being suspended from an electrical conductive line and having a chamber formed therein, said chamber adapted to transmit a detonation of explosives placed in said chamber to a driving mechanism of the down-hole tool;

a source of electrical current disposed within said housing;

an electrical igniter disposed within said housing in proximity to said chamber, said igniter being operable by application thereto of said current to ignite explosives placed in said chamber;

electronic means disposed within said housing for delaying application of said current to said igniter for a predetermined period of time;

a manually operable switch having an "off" position for preventing said application of said current and an "on" position for beginning said period of delay; and means for locking said switch in either of said positions.

7. The apparatus of claim 6, wherein said electrical current source comprises one or more batteries.

8. The apparatus of claim 6, wherein said delaying means further includes means for indicating that said period of delay is lapsing.

9. The apparatus of claim 6, wherein said period of time is about one hour.

10. An apparatus for providing a time-delayed activation of a down-hole explosive tool, comprising:

a longitudinal housing having first and second chambers formed therein, said first chamber adapted to transmit a detonation of explosives placed therein to a driving mechanism of the down-hole tool, said chambers separated by an explosion-resistant barrier;

an electrical igniter disposed within said first chamber and electrically grounded to said housing, said igniter being operable by conduction therethrough of an electric current to ignite explosives placed in said first chamber;

a battery disposed in said second chamber, said battery having positive and negative terminals;

a circuit board assembly mounted in said second chamber, said assembly including first, second, and third terminals;

means for conducting electrically from said positive terminal to said first terminal, said means including a manually operable switch having an "on" position allowing said conduction of electricity and an "off" position preventing said conduction of electricity;

means for locking said switch in either of said positions;

means for conducting electricity from said second terminal and said housing to said negative terminal; and means for conducting electricity from said third terminal to said igniter, said circuit board assembly being operable to conduct electricity from said first terminal to said third terminal after an elapse of a predetermined period of time following positioning said switch in said "on" position, thereby igniting said explosives.

11. The apparatus of claim 10, wherein said locking means is associated with an end closure for said housing.

12. The apparatus of claim 11, wherein said switch is disposed along the longitudinal axis of said housing and said end closure is a fishing neck provided with a roll pin.

* * * * *